US005279667A

United States Patent [19]

Blankenship et al.

[11] Patent Number: 5,279,667

[45] Date of Patent: * Jan. 18, 1994

[54] METHOD AND APPARATUS FOR COATING A STRIP

[75] Inventors: Milton E. Blankenship, North Canton, Ohio; Charles F. Robinson, Weirton, W. Va.

[73] Assignee: National Galvanizing Inc., Monroe, Mich.

[ * ] Notice: The portion of the term of this patent subsequent to Jun. 22, 2010 has been disclaimed.

[21] Appl. No.: 880,600

[22] Filed: May 8, 1992

Related U.S. Application Data

[63] Continuation-in-part of Ser. No. 596,499, Oct. 12, 1990.

[51] Int. Cl.[5] ..... B05C 11/06

[52] U.S. Cl. ..... 118/63; 118/419; 118/423

[58] Field of Search ..... 118/63, 419, 423; 239/432, 455, 343, 590, 518, 461, 597

[56] References Cited

U.S. PATENT DOCUMENTS 2,602,701 7/1952 Walter ..... 239/461
3,314,163 4/1967 Kohler .
3,526,204 9/1970 Schnedler et al. .
3,681,118 2/1970 Ohama et al. .
3,783,824 1/1974 Kohler .
3,841,557 10/1974 Atkinson .
3,977,359 8/1976 Bottaro .
3,998,181 12/1976 Bellen .
4,041,895 8/1977 Overton .
4,106,429 8/1978 Phillips .
4,198,922 4/1980 Gwilt .
4,259,006 3/1981 Phillips et al. ..... 118/63
4,330,086 5/1982 Nysted .
4,359,964 11/1982 Johnson .
4,418,100 11/1983 Bedwell et al. .
4,513,915 4/1985 Kohler et al. .
4,527,506 7/1985 Hoetzl .
4,697,542 10/1987 Kohler et al. .
4,719,129 1/1988 Caudill .

*Primary Examiner*—W. Gary Jones
*Assistant Examiner*—Brenda A. Lamb
*Attorney, Agent, or Firm*—Emch, Schaffer, Schaub & Porcello Co.

[57] ABSTRACT

Apparatus for controlling the thickness and distribution of coating on a sheet of material being drawn upwardly from a bath of liquid coating material includes upper and lower lip members having a fixed contour defining an elongated outlet orifice which has minimum gap opening at the central portion thereof and tapers outwardly to larger gap openings at the ends of such orifice.

26 Claims, 9 Drawing Sheets

METHOD AND APPARATUS FOR COATING A STRIP

CROSS REFERENCE TO RELATED APPLICATION

This is a continuation-in-part to application Ser. No. 07/596,499 filed Oct. 12, 1990.

BACKGROUND ART

The present invention relates to a method and apparatus for applying a coating to a web of material and more particularly to a low profile coating unit for use in hot dip galvanizing of a continuously moving strip of steel of indefinite length.

In the manufacture of galvanized steel by the hot dip process, a strip of steel is drawn through a molten bath of zinc or zinc alloy and drawn upwardly where it passes between a pair of air knives which blow air, steam or other fluid against the opposite sides of the sheet prior to the zinc or zinc alloy coating material becoming fully set in order to blow excess amounts of such coating material from the surface of the sheet and, by variations in pressure, spacing between the surface of the strip and the air knives and the time interval between exiting the bath and entry between the air knives, control the thickness of the galvanized coating on the strip of material. For example, ASTM specification 525 published by the American Society for Testing and Materials, Philadelphia, PA, provides for coating designations for regular types ranging from G 235 which has an optimum coating of 2.35 ounces per square feet of sheet (triple-spot test) to G 30 which has 0.30 ounces per square feet of sheet and even down to G 01 which has no minimum specified for the coating weight. Thus, for different applications different thickness of coating are desired. Additionally, for different applications of the finished product, it is desirable to have galvanized steel strips of different thicknesses. Thus, the thickness of the metal desired to be coated may be as thin as 0.010 inches or as thick as 0.250 inches.

The prior art shows many different types of apparatus and methods for processing the steel strip as it is drawn upwardly from the bath of molten zinc or other coating material including a wide variety of air knives of various designs and mechanisms for supporting and adjusting such air knives.

U.S. Pat. No. 3,783,824 is directed to an elevator construction for coating control equipment. The equipment disclosed in such patent platform shows means for supporting the air knives or air nozzles with the platforms supported by linkage means which has the capability of imparting straight line vertical motion and straight line horizontal motion to the platform means, and also provide means for moving the nozzle assemblies in a lateral direction relative to the strip.

U.S. Pat. No. 3,681,118 discloses a method of removing molten metal coatings by low pressure gas streams. A pair of nozzles are swingably mounted at opposite ends of sliders so that the gas ejection angle of the nozzles with respect to the opposite faces of the coated strip can be adjusted within the range of 3° to 45°. The mechanism permits the nozzles to be moved toward and away from the strip face independently of each other by supplying fluid under pressure to hydraulic cylinders. It also provides for a wedge mechanism for close adjustment of the spacing between the nozzles and the steel strip.

U.S. Pat. No. 4,719,129 discloses a plurality of rotatably mounted jet finishing knives mounted to an assembly which can be raised or lowered by a crank mechanism. The coating thickness of a strip can be varied simply by rotating the knives such that a knife having a different orifice height from the previous knife impinges pressurized gas against the web of material. The knives are enclosed in a protective atmosphere.

A number of prior art patents show specific designs of air knives. For example, U.S. Pat. No. 3,314,163 discloses a nozzle which may be opened for cleaning, which provides uniform jet across the width of the steel strip that is free of turbulence and which may have the gap and the angle of impingement adjusted independently of one another. Additionally, it discloses the desirability of eliminating or at least minimizing turbulence present in the air in order to provide a smooth flow of air against the surface of the strip being treated.

U.S. Pat. No. 3,526,204 discloses a knife which increases wiping action at the strip edges and which is adjustable for various strip widths.

U.S. Pat. No. 3,841,557 discloses nozzles of air knives in which the width of the gas outlet slot in each nozzle is controlled by thermally expanding at least a portion of the walls of the slot.

U.S. Pat. No. 3,977,359 discloses a composite air knife having shutters at both ends of the nozzle to adjust the effective length of the slot formed by the lips of such nozzle.

U.S. Pat. No. 4,041,895 discloses an air knife having internal devices to provide directionally controlled laminar flow that has a pressure profile which varies along the length of the knife.

U.S. Pat. No. 4,106,429 discloses an air knife with a slideable lip to permit adjustment of the opening.

U.S. Pat. No. 4,198,922 is directed to a gas barrier assembly for controlling coating thickness on a strip of steel after it leaves a bath of molten zinc. It discloses as prior art the feature of directing air against the steel strip from curved lip orifices as well as a new feature of providing support means having readily releasable connecting means which permits the gas orifice segment to be removed and replaced without removing the frame from the coating line.

Other patents which disclose various types of arrangements for opening or disconnecting for cleaning purposes include U.S. Pat. Nos. 4,359,964; 4,513,915 and 4,697,542.

The prior art devices, while suitable for many applications are massive in size, complex in their construction and lack the flexibility to handle a full range of steel strip thicknesses and coating gauges on a single line. Additionally, the prior art air knives are themselves complex and difficult to maintain.

DISCLOSURE OF INVENTION

The present invention provides a low profile coating unit having a coating die with a nozzle construction and supporting mechanism which are economical to build, easy to maintain and, in the case of the supporting mechanism, permits independent and wide-ranging adjustment in a vertical direction from a position immediately above the top of the bath of molten zinc to 30 inches or even more thereabove, horizontal movement of each of the nozzles on opposite sides of the strip from a point barely spaced therefrom to a point spaced therefrom a distance of 8 or more inches and lateral adjustment to maintain the nozzles centered on the strip of steel even though such strip of steel may drift laterally in one direction or the other over a period of time. Additionally, the mechanism and the method provided by the present invention permit coating on a continuous basis of indefinite lengths of steel covering a full range of desired thicknesses from 0.010 inches up to 0.250 inches and effective coating throughout a complete range of coating thicknesses from 2.35 ounces per square foot to less than 0.30 ounces per square foot. Equally importantly, the present invention permits the coating of steel strips moving at low speeds of less than 30 feet per minute as well as ones moving at higher speeds in the range of 300–500 feet per minute. Additionally, it is possible to obtain variations in coating weights by increasing or decreasing the pressure of the air being directed against the web. The air pressure may vary from as low as ¼ psi to as high as 5 psi measured at the inside of the air nozzle. The air nozzle itself includes a new and novel design and provides for balanced air flow as a result of the lip design in combination with a new design of inlet manifold and diffuser. The air nozzle includes upper and lower lip members each having a precut and fixed contour and joined together to cooperate to define an outlet orifice extending transversely with a central portion of minimum gap opening and tapering to maximum gap opening at opposite ends.

Accordingly, it is an object of the present invention to provide apparatus for controlling the thickness of a coating on a strip of metal being drawn through a bath of coating material throughout a full range of coating thicknesses and strip thicknesses.

It is a further object of the present invention to provide new and novel air nozzle means for controlling coating thickness on a steel strip which may be readily maintained, which are less susceptible to clogging than prior art nozzles, which do not require adjusting and which may be readily and rapidly removed and replaced with minimal disruption of production.

Other objects and advantages of the present invention will become readily apparent from the following detailed description in conjunction with the appended sheets of drawings.

BEST MODE OF CARRYING OUT INVENTION

Figure 1:
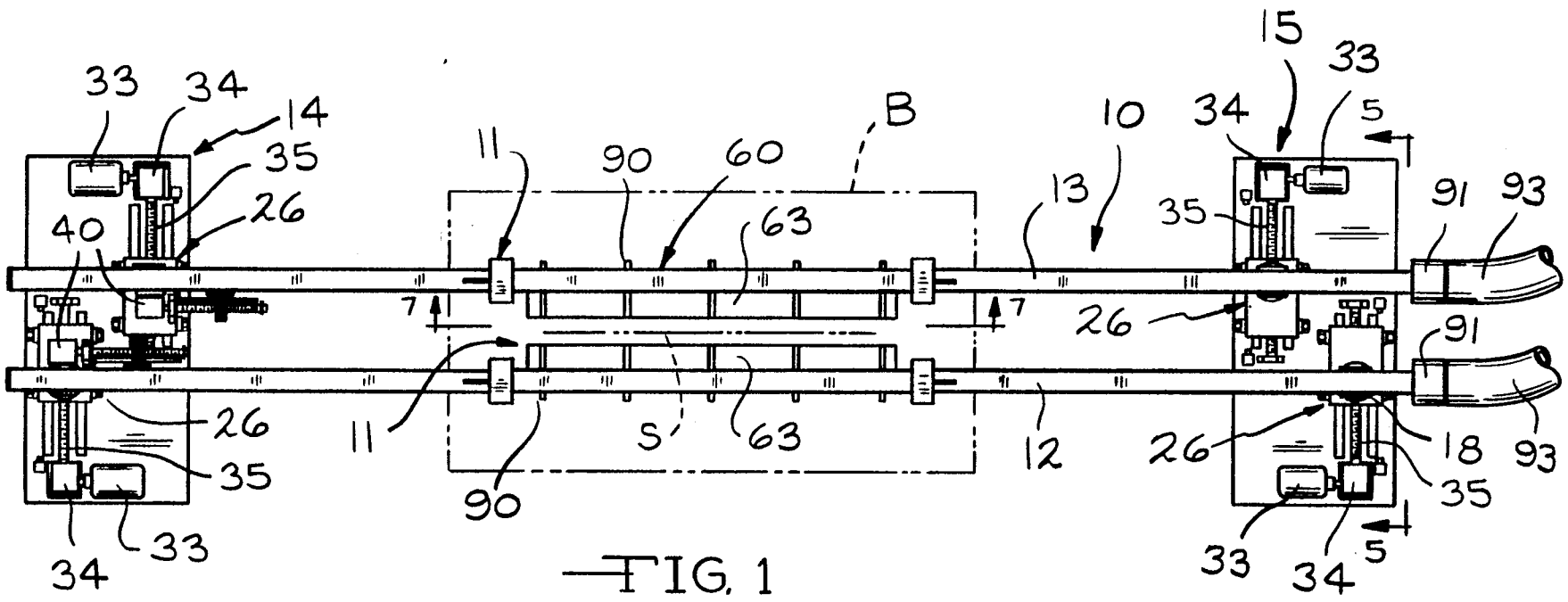
FIG. 1 is top plan view of the low profile coating unit of the present invention.

Referring now to the drawings there is provided a low profile coating unit generally designated by the numeral 10 which includes a pair of air knife assemblies generally designated 11 mounted above a bath of molten zinc or other coating material B, one on each side of a strip of metal S which is being drawn upwardly from the coating bath B by conventional means well-known in the art.

The air knife assemblies 11 are supported, one on a first coating die hanger 12 and the other one a second coating die hanger 13. Each of the coating die hangers is supported at its opposite ends on a left table mechanism 14 and a right table mechanism 15.

Each of the coating die hangers 12 and 13 is mounted on the tables 14 and 15 for lateral movement independently of any other movement, for horizontal movement independently of any other movement toward or away from the strip S being drawn upwardly out of the bath B and vertical movement independently of any other movement from a position just above the top surface of the molten bath B to a point as much as 30 inches or even more above such surface. Thus, the mounting permits the air knife assemblies 11 to be positioned at their optimum positions with respect to the strip S for the specific thickness of strip S being coated, specific thickness of coating desired and specific speed at which the strip is being drawn upwardly from the molten bath B and furthermore permits instantaneous adjustment of the air knives upon changes in the thickness of the strip S or the coating or changes in such speed. Additionally, the mechanism providing for lateral adjustment of the coating die hangers 12 and 13 permits the position of the air knife assemblies 11 to be adjusted laterally to accommodate any lateral drift of the strip S.

As seen most clearly in FIGS. 2–5, the coating die hanger 12 is supported in channel holders 18, one at each end on supporting mechanism secured to the left table 14 and the right table 15, respectively. The second coating die hanger 13 is also mounted on channel holders 18 similarly supported. Each channel holder 18 includes a pair of side plates 19 and a bottom plate 20. The channel holder 18 has four rollers 21, mounted two on each side plate 19 and extending above the bottom plates 20 beyond opposite ends thereof so that the top of each of the rollers 21 is just above the bottom plate and supports the bottom of the coating die hanger 12 thus permitting lateral movement of the coating die hanger 12 therein. The construction of the channel holders 18 at the opposite end of the coating die hanger 12 and at both ends of the second coating die hanger 13 are similar.

Each channel holder 18 is mounted on a threaded post 17 engaged to threaded sleeve 24 welded to a bottom plate 25 supported on a rig car frame 26. Each rig car frame 26 has spaced apart side walls 22 supporting a top 23 on which the bottom plate 25 is mounted. A plurality of rollers 27 mounted on bolts 28 extend through the side walls 22 of the rig car frame 26. The rollers 27 roll on a pair of spaced apart tracks 29 positioned on a base plate 30 of the respective left table 14 and right table 15. The threaded post 17 may be rotatably adjusted in the threaded sleeve 24 to raise or lower the channel holder 18 at each end as necessary to maintain the coating die hangers 12 and 13 horizontal.

Horizontal movement of the respective rig car frames 26 and therefore the coating die hangers 12 and 13 and air knife assemblies carried thereby toward and away from strip S is powered by means of motors 33 acting through gear boxes 34 to turn threaded rods 35 extending from such gear boxes 34. Each of the threaded rods 35 is supported at its end on a pillow block 36 and engages a threaded nut 37 bolted or otherwise secured to a plate 38 rigidly secured to and extending between the side walls 22 of the rig car frame 26. Thus, rotation of the threaded rod 35 in one direction will cause the rig car frame 26 to move the air knife assembly closer to the strip S of metal being drawn upwardly from the molten bath B while rotation of the threaded rod 35 in the other direction will cause it to move the air knife assembly 11 further away from such strip.

Lateral movement of each of the coating die hangers 12 and 13 is accomplished by means of motors 40 mounted on the table 14. Each motor 40 rotates a threaded rod 41 extending therefrom and supported on a pillow block 42. The threaded rod 41 is threadedly engaged to a side adjust nut 43 and having a V-shaped notch 44 at its upper end.

Each of the coating die hangers 12 and 13 has bolted thereto a side adjust bracket 45 having an outwardly extending plate 46 positioned within the V-shaped notch 44. Thus, rotation of the threaded rod 41 by means of the motor 40 causes the side adjust nut 43 to be moved in one direction or the other depending upon the rotation of the threaded rod. Such movement will cause the respective coating die hanger 12 or 13 to move laterally as the threaded rod 41 is rotated. A guide rod 47 mounted on n plate 48 fastened to a side wall 22 of rig car frame 26 extends through an aperture of the side adjust nut 43 and assists in guiding the lateral movement thereof.

As will be appreciated and as can be seen from FIGS. 1-5, the mechanism for moving the coating die hangers 12 and 13 horizontally closer to or further away from the oncoming strip S of metal being drawn upwardly from the bath B requires that each end of each of the coating die hangers 12 and 13 be equipped with the power means and moving mechanism. Thus, there are provided a total of four motors 33 powering threaded rods 35, one on table 14 for moving the left end of coating die hanger 12, one on table 15 for moving the opposite end of the coating die hanger 12, one on table 14 for moving the left end of coating die hanger 13 and one on table 15 for moving the other end of coating die hanger 13. Since each of these is mounted in similar fashion, no further description need be given for such connecting mechanisms. In contrast to having four motors for providing such horizontal movement toward and away from the oncoming strips, only two motors 40 are required for moving the coating hanger dies 12 and 13 laterally, one motor for each hanger. Both of the motors 40 are positioned on the table 14 and no corresponding motor is required to be positioned on the table 15.

Figure 2:
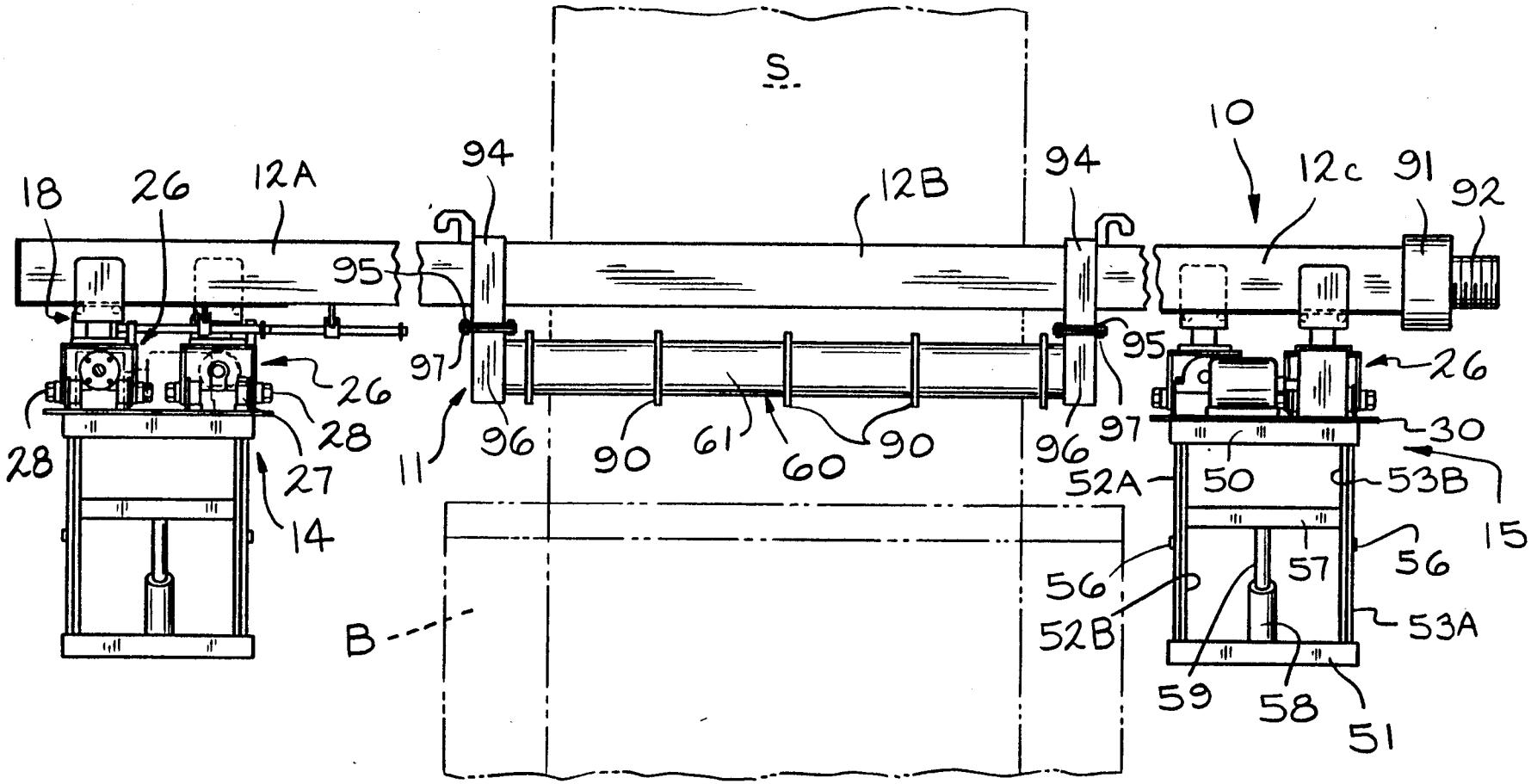
FIG. 2 is an elevational view of such low profile coating unit.
Figure 4:
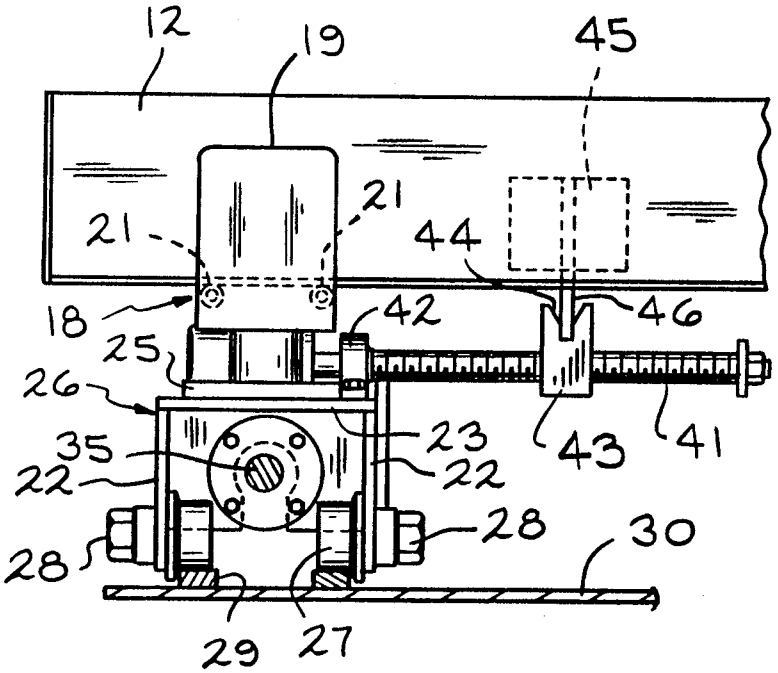
FIG. 4 is a view taken through line 4—4 of FIG. 3.
Figure 3:
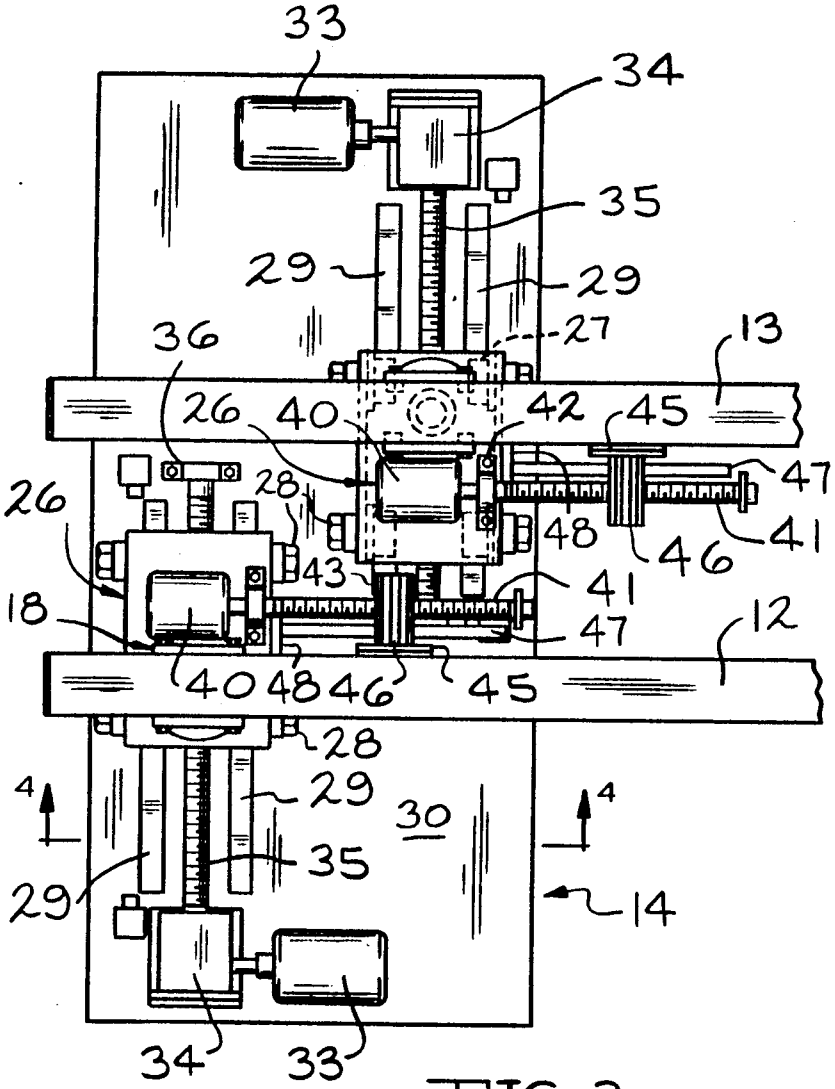
FIG. 3 is an enlarged fragmentary elevational view of one end portion of the low profile coating unit.
Figure 5:
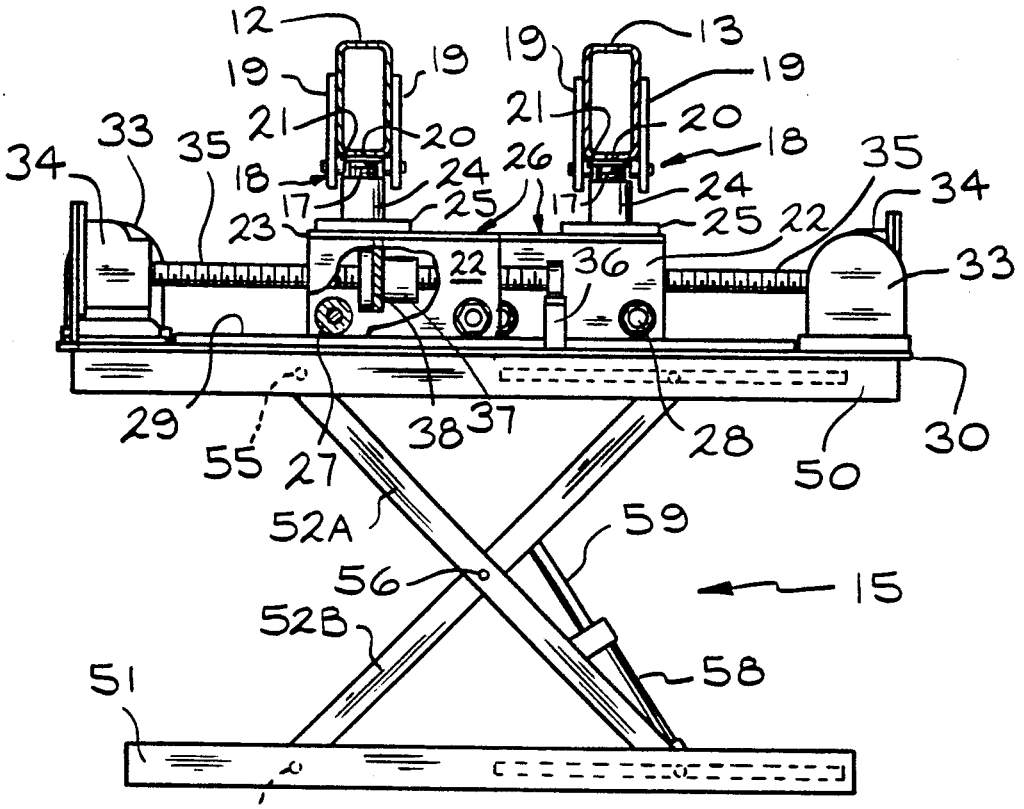
FIG. 5 is an end view of the low profile coating unit.
Figure 9:
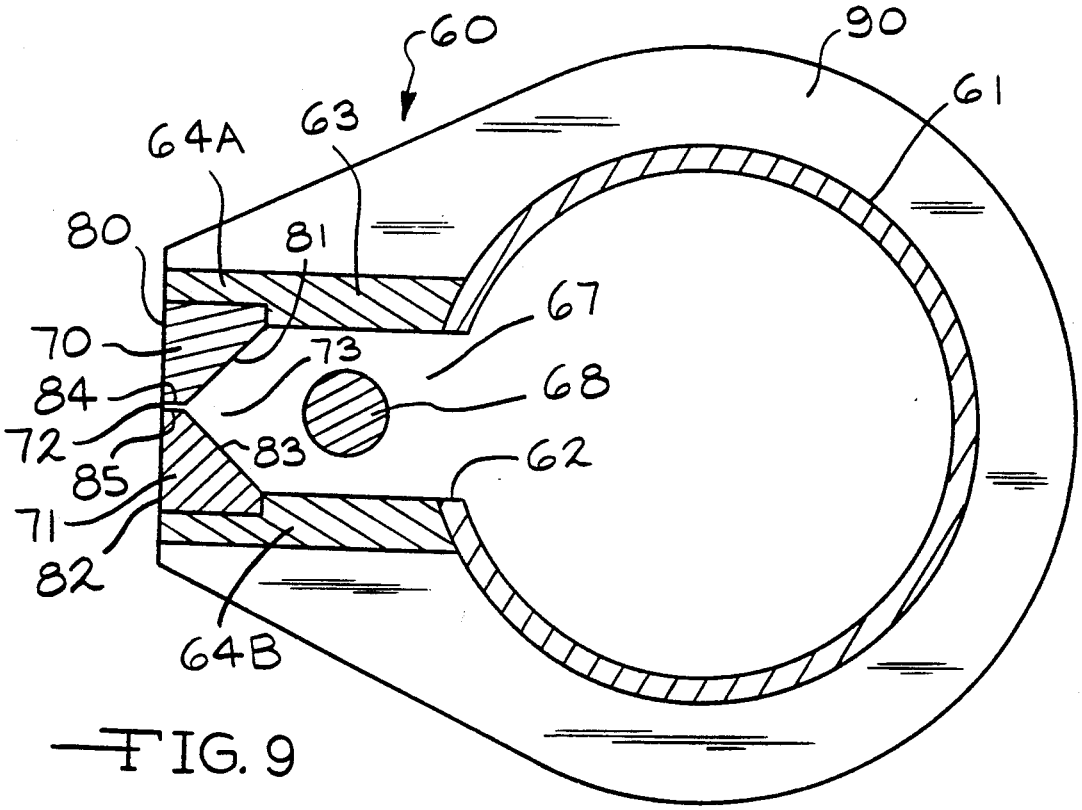
FIG. 9 is a sectional view of the air knife assembly taken through line 9—9 of FIG. 6.

The tables 14 and 15 are constructed to permit vertical movement and each table includes an upper support frame 50 and a base 51 each of which defines a generally rectangular configuration. Two sets of pivot bars, 52A, 52B and 53A, 53B connect the upper support frame 50 to the base 51 for vertical movement with respect to each other. As shown in FIGS. 2 and 5, the lower end of pivot bar 52B is pivotally secured to a fixed point on the base 51 by means of a bushing and pin 54 and the opposite end of the pivot bar 52B is slidingly secured to the upper support frame 50 by any desired sliding connector means. The pivot bar 53B is similarly secured with its lower end pivotally secured to a fixed pivot point and its upper end slidingly secured. The pivot bars 52A and 53A have their upper ends pivotally secured to the upper support frame 50 by means of bushings and pins 55 and their lower ends slidingly connected to the base 51 by any desired connector means. Each of the sets of pivot bars 52A, 52B and 53A, 53B is pivotally connected to its mate by a centrally located bushing and pin 56.

A lateral connector 57 is secured to the pivot bar 52B at one end and to the pivot bar 53B at the other end. A hydraulic cylinder 58 having a piston rod 59 secured to the lateral connector 57 provides the power means for raising and lowering the table. Such connector means is similar to deck supports sold by American Industrial Torque Lift ® as its Model T-I series, a description of which is attached and incorporated herein by reference.

The air knife assemblies 11 rigidly secured to each of the coating die hangers 12 and 13 includes a coating die holder 60. Except for being faced in opposite directions in order to have the air knives directing the pressurized fluid on opposite sides of the strip S, these coating die holders 60 are identical. Accordingly, only one will be described. The coating die holder 60 includes an elongated tube 61 having an outside diameter on the order of 6 inches or greater and an elongated slot 62 extending a distance greater than the width of the strip S of metal. Welded to the tube 61 and encircling the slot 62 is a nozzle holder 63 having upper and lower walls 64A and 64B and end walls 65 and 65B. The nozzle holder 63 defines a chamber 67 through which pressurized fluid, usually air or steam, must pass prior to impinging against the metal strip S. The upper and lower walls 64 and 64B of the nozzle holder 63 extend to free ends, each of which have notched areas of reduced thickness for receiving therein an upper nozzle 70 and a lower nozzle 71.

Positioned in the chamber 67 approximately midway between the slot 62 of the tube 60 and the rear of the nozzles 70 and 71 is an air diffuser 68 supported at its opposite ends at the end walls 65A and 65B. Preferably the air diffuser has a circular cross-sectional configuration; however, it could have an oval or other curved cross-sectional configuration.

The upper nozzle 70 and the lower nozzle 71 are each formed in one piece and are precisely cut to define, when assembled, on outlet orifice 72 having a specific configuration and a specific configuration of inlet 73 for receiving pressurized fluid from the chamber 67.

The upper nozzle 70 is provided with a flat front face 80 on the outlet orifice 72 side and a downwardly and inwardly tapering rear face or flow surface 81 on the opposite side. Similarly the lower nozzle 71 is provided with a flat front face 82 and an inwardly and upwardly tapering face or flow surface 83 on its side away from the outlet orifice 72. The respective tapering flow surfaces 81 of the upper nozzle 70 and 83 of the lower nozzle 71 do not extend completely to their respective front faces 80 and 82 but terminate in lips 84 and 85, respectively, which cooperate when the upper and lower nozzles 70 and 71 are assembled in the nozzle holder 63 to define outlet orifice 72. The tapered flow surfaces 81 and 83 cooperate with the air diffuser 68 and with the other surfaces to provide a smooth air flow with a minimum of turbulence. The angle of taper between the flow surface 81 and the flow surface 83 could vary between 30° and 145°.

Figures 6, 7, 8:
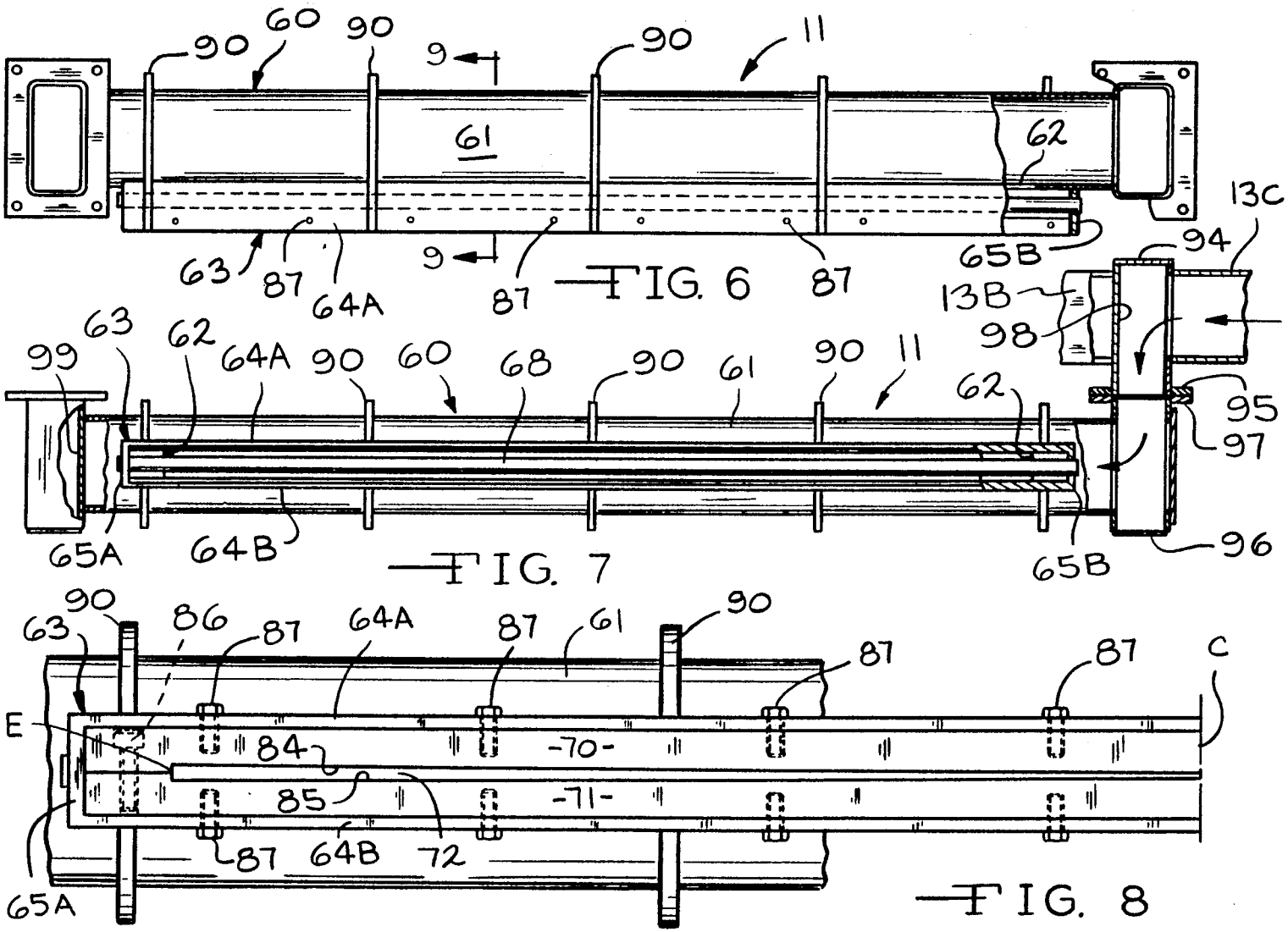
FIG. 6 is a top plan view showing one of the air knife assemblies of the low profile coating unit of the present invention.
FIG. 7 is a view of the air knife assembly looking in the direction of line 7—7 of FIG. 1 but with the nozzle members removed for clarity.
FIG. 8 is a fragmentary enlarged view of a portion only of the air knife assembly looking in the same direction as FIG. 7 showing the configuration of the precut tapered nozzles defining the outlet orifice.

Referring specifically to FIG. 8, there is shown, in greatly enlarged form, approximately one-half of the upper nozzle 70 and lower nozzle 71 mounted in the nozzle holder 63. An important feature of the present invention is providing a smooth flow of air or other pressurized fluid through the tube 61, chamber 67 and outlet orifice 72 for impingement against the strip S of metal with a minimum of turbulence and with maximum control of flow direction of the pressurized fluid as it impinges against the steel strip S to properly distribute the coating thereon to the desired thickness in a uniform manner across the width of the strip S. This is accomplished by providing, in addition to the configuration of the tube 61, chamber 67 and air diffuser 68, lips 84 and 85 having a specific configuration cooperating to define an elongated outlet orifice 72 which is narrower in the center C and wider at the edges E. Thus, as can be seen in FIG. 8, the upper lip 84 tapers downwardly from the edge E toward the center at a substantially uniform angle while the lower lip 85 tapers upwardly at substantially the same angle. Preferably, the portion of the respective lips 84 and 85 spanning the centerline are horizontal and are parallel to each other in that area. Thus, for example, assuming that the outlet orifice 72 has a length of 60 inches, the outer 26 inches of each end will be tapered and the center 8 inches will be parallel. Preferably, the gap between the upper and lower lips in the center C is 0.050 inches; however, it could be anywhere in the range of 0.020 inch to 0.090 inch. The spacing between the upper and lower lips 84 and 85 at the sides S is preferably approximately 0.100 inches; however, it could be anywhere in the range of 0.040 inch to 0.20 inch. For various thicknesses of strips and coatings the length of the center parallel portion may vary as may the size of the gap.

The upper and lower nozzles 70 and 71 are fastened together by bolts 86 and are thereafter inserted in the nozzle holder 63 and supported therein by bolts 87.

As will be appreciated, for purposes of clarity in viewing the interior of the nozzle holder 63, FIG. 7 is shown without the upper and lower nozzles 70 and 71 positioned therein. Thus, as can be readily seen the air diffuser 68 extends from opposite ends 65 and 65B of the nozzle holder 63.

Welded or otherwise secured to the tube 61 and the nozzle holder 63 are a plurality spaced apart support ribs 90. The coating die hanger 12 is hollow and has connected thereto at one of its ends, the right end as shown in FIGS. 1, 2 and 7, a coupling 91 with an end cap from which a threaded pipe 92 extends for receiving pressurized fluid from a hose 93.

As can be seen in FIGS. 2 and 7, the coating die hangers 12 and 13 are formed in three sections, 12A, 12B and 12C and 13A, 13B and 13C which are joined by tubular shaped couplings 94 having outwardly extending flanges 95 at their lower ends. If desired, each of the coating die hangers could be formed in one section and/or could have a circular cross-sectional configuration. The coating die holder 60 is also provided with couplings 96 having flanges 97 intended to be secured to the flanges 95 of the respective coating die hanger 12 or 13, thus providing support means for securing the coating die holder 60 on its coating die hanger 12 or 13. The coupling 94 closest to the air inlet threaded pipe 92 (i.e., the right hand coupling 94 as shown in FIGS. 2 and 7) has an end wall 98 blocking the flow of pressurized air beyond that point of the coating die hangers 12 and 13 and directing the flow of such air through the coupling 94 between the flanges 95 and 97 into coupling 96 and then into the coating die holder 60, through the elongated tube 61, through the chamber 67, around the air diffuser 68, between the joined upper and lower nozzles 70 and 71, and through the outlet orifice 72. The elongated tube 61 is provided with an end cap 99 preventing the flow of pressurized fluid beyond the left end of the tube 61 as viewed in FIGS. 6 and 7.

In operation, a strip S of steel of predetermined thickness is drawn upwardly from the bath B at a predetermined rate of speed depending upon the mass of the steel strip. For example, a thick strip of steel, say on the order of 0.25 inches in thickness which is desired to be coated with a coating thickness of 0.90 ounces per square foot will move upwardly at a rate of speed between 20 and 35 feet per minute while a strip S of steel having a thickness of 0.010 inches and a desired coating thickness of 0.90 ounces per square foot may travel upwardly at a rate of speed between 300 and 500 feet per minute. For a strip of steel traveling at the lower speeds, the left and right tables 14 and 15 will be positioned in their lowered positions so that the lower end of the nozzle holder 63 is just above the upper surface of the bath B if the strip is to have a thin coating on the order of 0.20 ounces per square foot and somewhat higher if the strip S is to have a heavier coating of, say, 2.35 ounces per square foot. As will be appreciated, the motors 33 will cause the threaded rods 35 to move the coating die hangers 12 and 13 to the desired position away from the opposite surfaces of the strips, between ¼ inch and 8 inches. Additionally, as previously mentioned, varying the air pressure will also influence the thickness of the coating with a higher pressure resulting in a thinner coating and a lower pressure in a thicker coating assuming, of course, that all other variables are constant. If desired, a computer controlled system may be incorporated to automatically adjust the height, spacing and/or air pressure to obtain the desired thickness with maximum operating efficiency. As the strip S moves upwardly through the bath, the edges may have a tendency to drift laterally to the right or to the left. Upon viewing such lateral drift, the operator may activate the motors 40 to cause the threaded rods 41 to rotate moving the threaded nut 42 and carrying with it the plate 46 positioned in the V-shaped notch 44 thereby moving the coating die hangers 12 and 13 laterally. If desired optical sensing means may be provided to sense the lateral drift of the edges of the strip and may be interconnected with the motors 40 to automatically adjust the lateral position of the coated die hanger and of the air knife mechanism carried thereby.

Referring now to FIGS. 10–16, there is shown a modified and preferred air knife assembly 111. The air knife assembly is supported on a coating die hanger 112 which is supported at its opposite ends on table mechanisms (not shown) such as those shown and described in the embodiment of FIGS. 1–9. Although only one air knife assembly 111 and one coating die hanger 112 will be shown and described, it will be understood that a similar air knife assembly and coating die hanger will be positioned on the opposite side of the sheet of steel to be coated.

The air knife assembly 111 includes a coating die holder 120 with an elongated tube 121 having an elongated slot 122 extending a distance greater than the width of the strip of metal to be coated. Welded to the tube 121 and encircling the slot 122 is a nozzle holder 123 having upper and lower walls 124A and 124B and end walls 125A and 125B. The nozzle holder 123 defines a chamber 127 through which pressurized fluid must pass prior to impinging against the metal strip. The upper and lower walls 124A, 124B, extend to free ends, each of which have notched areas 126 of reduced thickness for receiving therein an upper nozzle 130 and a lower nozzle 131.

The coating die holder 120 is fastened to the coating die hanger 112 by means of tubular couplings 134 welded to and extending downwardly from the coating die hanger 112. Each of the tubular couplings 134 has a passageway 134A communicating with and receiving pressurized fluid from the coating die hanger 112 and terminates at a downwardly facing outwardly extending flange 135.

A plurality of spaced apart support ribs 190 are welded or otherwise secured to the elongated tube 121 and the nozzle holder 123. For purposes of clarity, the support ribs 190 are not shown in FIG. 16.

The coating die holder 120 is provided with hollow couplings 136 welded or otherwise secured at opposite ends of the tube 121 and having flanges 137 intended to be secured to the flanges 135 of the tubular couplings 134 by means of bolts 138. Each of the couplings 136 communicates with the passageway 134A of the coupling 134 and has an opening 139 communication with the interior of the elongated tube 121. Each of the couplings 136 is closed by means of an end wall 140. Thus, pressurized air or other fluid flowing through the coating die hanger 112 and into the passageways 134A of the tubular couplings 134 will be directed into opposite ends of the tube 121 and then into the chamber 127 through the slot 122. Thus, in contrast to the previous embodiment shown in FIGS. 1–9, under the present embodiment such pressurized air is directed into both ends of the tube 121.

As will be appreciated, occasionally dust and other foreign particles may be in the pressurized air as it is introduced into the tube 121 from the coating die hanger 112. Under the present embodiment, means are provided for removing at least a portion of such dust and foreign particles from the pressurized air as it is flowing into the tube 121. As can best be seen in FIGS. 11 and 16, the coupling 136 is provided with a second opening 141 on the wall opposite the opening 139 into the tube 121. Positioned in such opening 141 is a permanent magnet 142 mounted on a plate 143 which is fastened to the wall of the coupling 136 by means of bolts 144. As shown, the magnet 142 has an annular or donut configuration; however, any of a wide variety of configurations are satisfactory. Additionally, as shown, magnets 142 are provided on each of the couplings 136 so that pressurized fluid entering the tube 121 from either direction will pass through the magnetic field created by such magnets 142 and the particles attracted to and adhered to such magnets. However, it has been shown that satisfactory results can be achieved with a magnet 142 at only one end of the tube 121. As will be appreciated, it is desirable that the plates 143 be removed periodically in order to clean any such foreign particles from the magnets 142.

In order to provide satisfactory distribution of coating on the metal strip being drawn between the spaced apart air knife assemblies 111, it is desirable to not only provide a diffuser bar as in the embodiment of FIGS. 1–9, but also to provide means for stabilizing such diffuser bar and means for adjusting the location of such diffuser bar closer to or further from the outlet aperture to meet the desired coating requirements for the specific job being manufactured. As previously mentioned, the upper nozzle 130 and lower nozzle 131 are positioned within the nozzle holder 123 with the upper nozzle 130 fastened to the upper wall 124A by bolts 146 extending through apertures 147 in the upper wall 124A engaging threaded holes 148 tapped in the upper surface of the upper nozzle 130. The lower nozzle 131 is similarly bolted to the lower wall 124B. As in the previous embodiment the upper and lower nozzles 130 and 131 cooperate to define an outlet aperture 149 which has a larger gap at the ends and a smaller gap in the center.

Positioned within the chamber 127 is an air diffuser 150 bar which extends substantially the entire distance between the end walls 125A and 125B of the nozzle holder 123.

The air diffuser bar 150 is notched at its ends to provide a flat face 157 at the end. The nozzle holder 123 in the area adjacent each of the end walls 125A and 125B has machined therein a receiving well 158 for receiving the end portions of the air diffuser bar. The receiving well 158 has a flat face 159 to which the flat face 157 of the air diffuser bar is engaged. The diffuser bar is retained in the receiving well by means of bolts 160 extending through apertures 161 at the ends of the air diffuser bar 150 and received in a threaded aperture in the receiving well 158.

Figure 12:
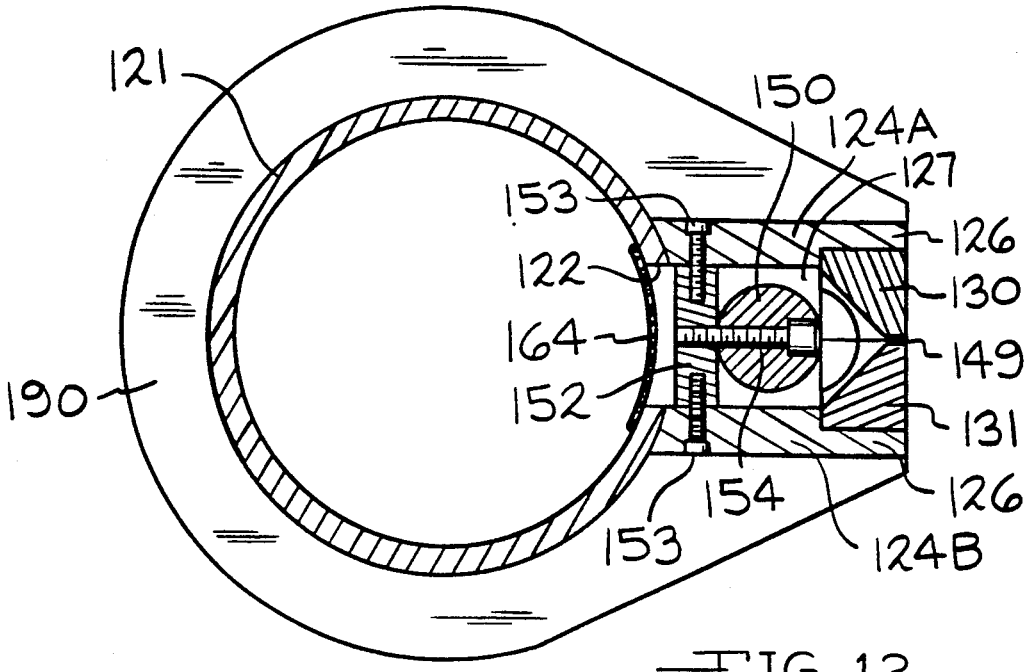
FIG. 12 is a sectional view taken through line 12—12 of FIG. 10.
Figure 13:
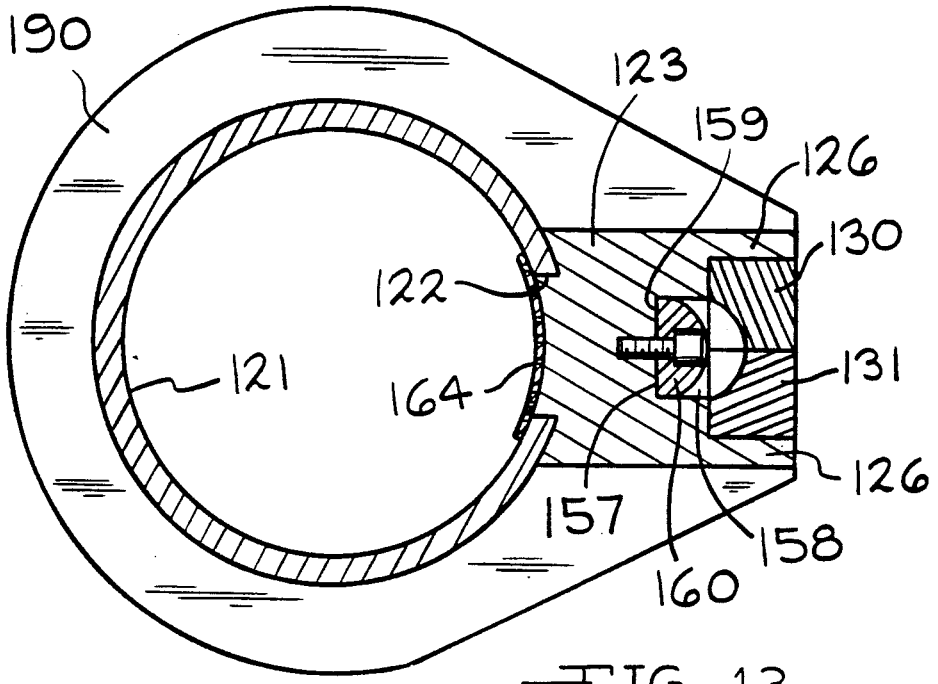
FIG. 13 is a sectional view taken through line 13—13 of FIG. 10.

A plurality of stiffener bars 152 are secured on the opposite side of the diffuser bar 150 from the outlet aperture 149 and are supported between the upper and lower walls 124A and 124B by bolts 153 engaging both their upper and lower ends. As shown in FIG. 12, the diffuser bar 150 is secured to each of the stiffener bars 152 by means of bolts 154.

Figures 10, 11:
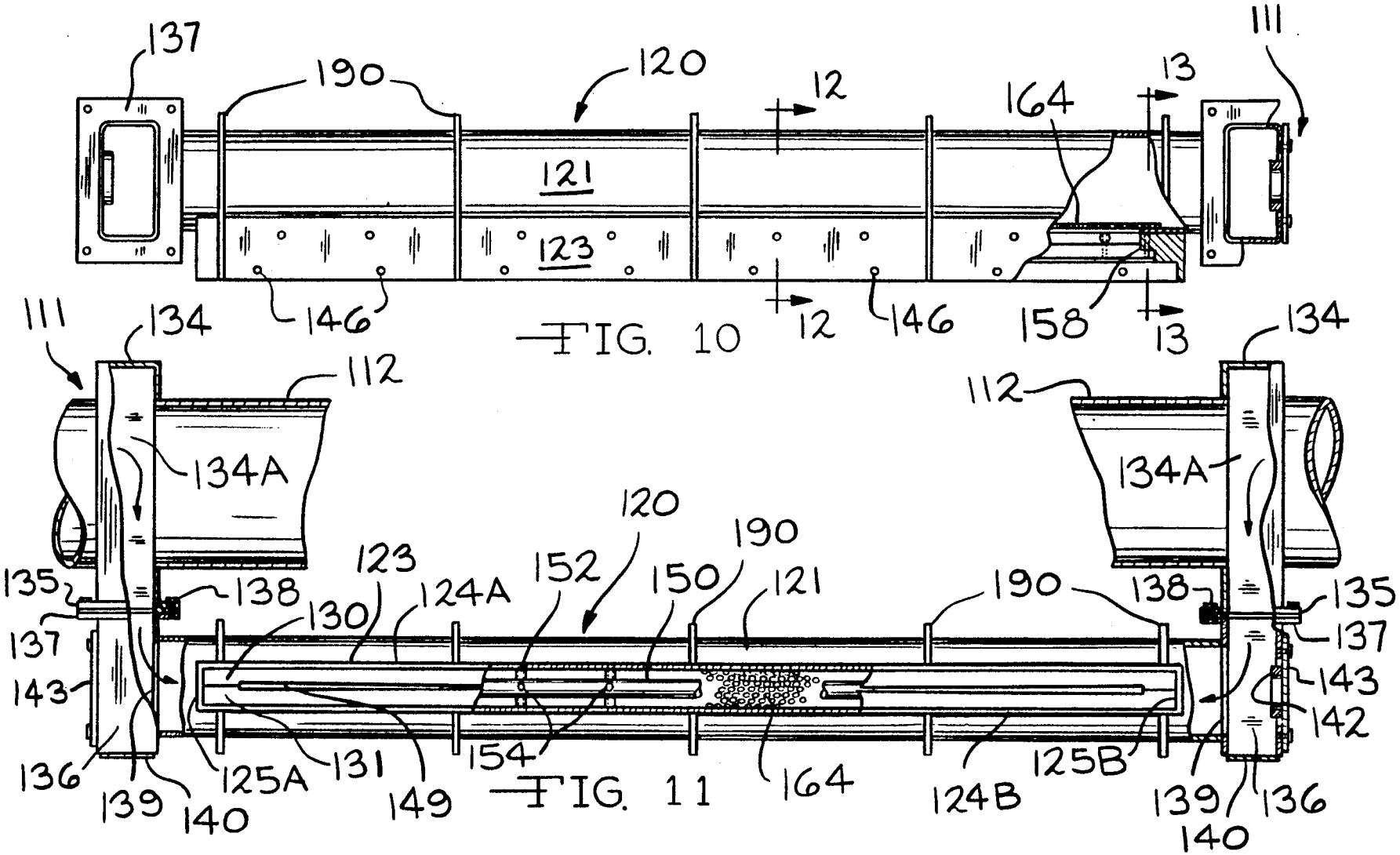
FIG. 10 is a top plan view showing one of the air knife assemblies of a modified embodiment for the low profile coating unit.
FIG. 11 is an elevational view, partially in section, of the modified embodiment shown in FIG. 10.
Figure 16:
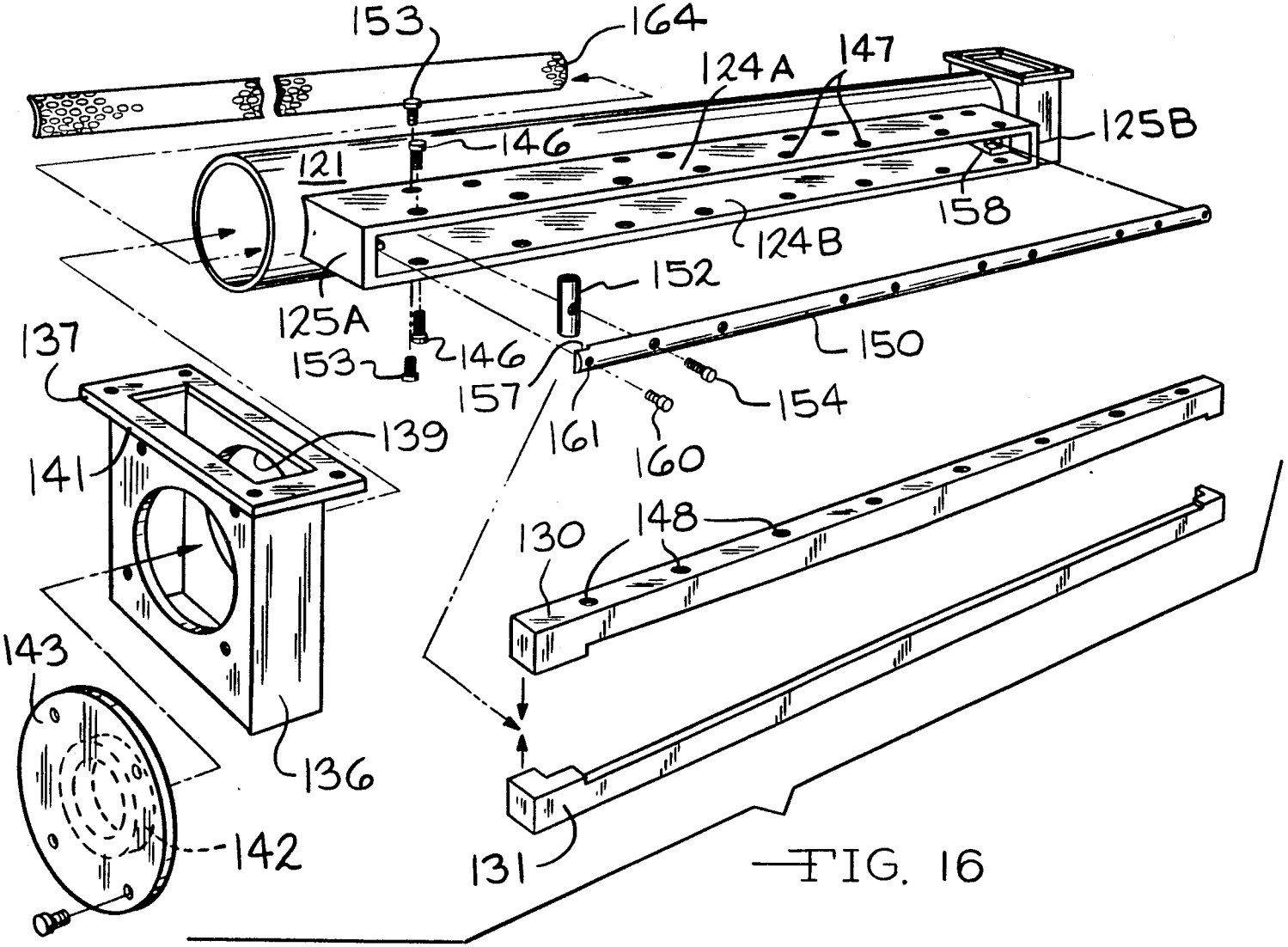
FIG. 16 is a fragmentary exploded perspective showing specific elements of the modified embodiment.

As shown particularly in FIGS. 10, 11 and 16, there are 8 stiffener bars 152 for supporting the air diffuser bar 150 from sagging and from lateral deflection as a result of pressured fluid passing thereby. The stiffener bars 152 are spaced apart in 4 sets of pairs with each pair of stiffener bars being substantially the same distance apart and with the stiffener bar of one pair spaced further from the stiffener bar of the adjacent pair than the distance it is spaced from the other member of its pair.

Positioned over the slot 122 and welded to the periphery thereof is a screen 164 having a series of holes having diameters of approximately ⅜" and positioned on ½" centers with a staggered pattern. Such screen 164 serves to provide an additional degree of diffusion to the pressurized fluid flowing from the tube 121 into the chamber 127 around the air diffuser 150 and stiffener bars 152 and through the outlet aperture 149 defined by the upper and lower nozzles 130 and 131. As may be seen from FIGS. 12 and 13, the screen 164 preferably has an arcuate configuration as viewed in section with the outer surface following an arc having a diameter equal to the inner diameter of the tube 121. Alternatively, the screen could be flat; however, in that event, it is desirable that the screen have ends engaged to and welded to the inner surface of the tube.

Figure 14:
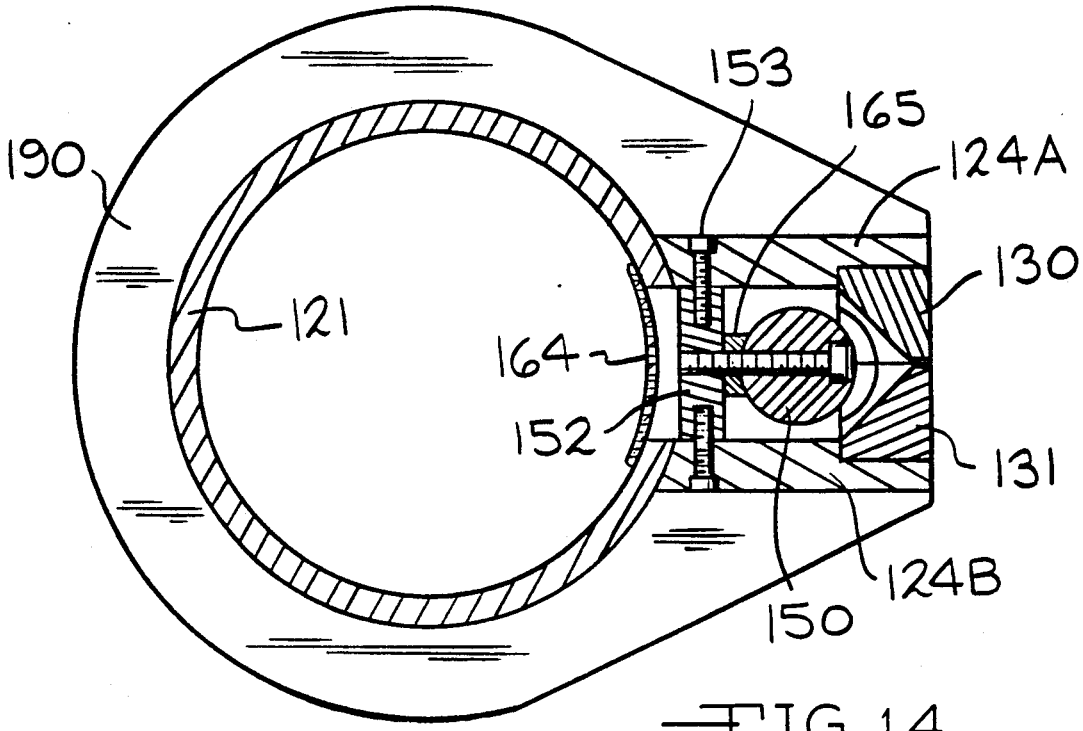
FIG. 14 is a view similar to FIG. 12 showing the deflector bar adjusted to a position closer to the outlet orifice.
Figure 15:
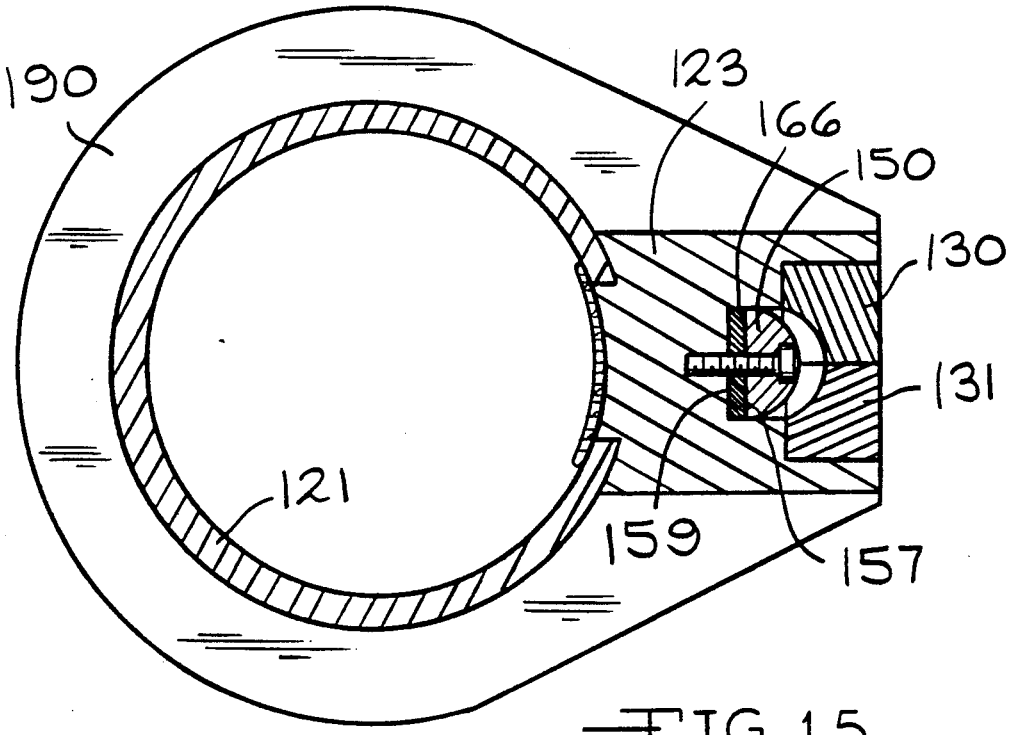
FIG. 15 is a view similar to FIG. 13 showing end of the deflector bar positioned closer to the extrusion orifice.

Referring now to FIGS. 14 and 15, there is provided means for adjusting the air diffuser bar 150 to a position closer to the outlet aperture 149 defined by the upper and lower nozzles 130 and 131. Thus, depending upon the precise thickness and distribution of coating desired for the metal sheet the diffuser bar 150 will desirably be closer to or further from such upper and lower nozzles 130 and 131. In order to make such adjustment, a plurality of shims 165 are provided, one for each of the stiffener bars 152 and two other shims 166 are provided, one for each end to be positioned between the respective flat face 157 of the air diffuser bar 150 and flat face 159 of the nozzle holder 123. As can be seen in FIG. 14, the shims 165 have an arcuate face contoured to match the outer surface of the air diffuser bar 150 while the shims 166 have a pair of parallel flat faces. A plurality of sets of shims 165 and 166 of varying thicknesses are contemplated with the specific thickness to be used being dependent upon the desired distance from the air diffuser bar 150 to the upper and lower nozzles 130 and 131. This will, as previously mentioned, depend upon the precise coating requirements for the job in question.

If desired, in lieu of having separate shims 165, 166, one for each of the stiffener bars 152 and one for each end, a single shim extending the full length of the diffuser bar 150 may be provided for each of several thickness variations.

The preferred embodiment of FIGS. 10–16 has proven to provide exceptionally accurate coatings tailored to meet a variety of desired specifications. The utilization of the magnets to remove dust and other particles from the pressured fluid being impinged against the sheet results in a finished coated product of exceptional quality. The screen 164 in combination with the air diffuser bar 150 housing in the nozzle holder 123 cooperate with the upper and lower nozzles 130 and 131 to provide an even flow of pressurized fluid from the outlet aperture 149.

Many additional modifications to the present invention will become readily apparent to those skilled in the art. Accordingly, the scope of the present application should be limited only by the scope of the claims appended hereto.

We claim:

1. Apparatus for controlling the thickness and distribution of coating on a sheet of material being drawn upwardly from a bath of liquid coating material comprising:

(a) upper and lower lip members extending transversely of said sheet, each of said upper and lower lip members having a fixed contour and cooperating to define an elongated outlet orifice, said orifice having opposing ends and a central portion therebetween, and having minimum gap opening at said central portion and tapering to maximum gap opening at each of said ends;

(b) fluid supply means for supplying fluid under pressure;

(c) support means for supporting said upper and lower lip members and defining a chamber for receiving pressurized fluid from said fluid supply means and directing said pressurized fluid toward said outlet orifice;

(d) an elongated diffuser bar positioned in said chamber spaced from and substantially parallel to said outlet orifice; and (e) means for supporting said diffuser bar from deflection.

2. Apparatus according to claim 1, wherein said means for supporting said diffuser bar from deflection comprises a plurality of spaced apart stiffener bars supported on said support means within said chamber.

3. Apparatus according to claim 2, wherein said stiffener bars are positioned on the opposite side of said diffuser bar from said outlet orifice.

4. Apparatus according to claim 3 further including means for adjustably fastening said diffuser bar to said stiffener bars in any of a plurality of positions at varying distances from said outlet orifice.

5. Apparatus according to claim 1 further including means for adjustably supporting said diffuser bar in positions relatively closer to or further from said outlet orifice.

6. Apparatus according to claim 1 further including magnet means for removing particles from said pressurized fluid prior to its reaching said outlet orifice.

7. Apparatus according to claim 1 further including magnet means positioned between said fluid supply means and said elongated diffuser bar.

8. Apparatus according to claim 1 further including a perforated screen positioned between said fluid supply means and said elongated diffuser bar.

9. Apparatus according to claim 8 wherein said perforated screen has holes over substantially the entire surface, said holes having a size in the range of 0.1 to 0.2 square inch and being substantially uniformly spaced apart from one another.

10. Apparatus according to claim 8 further including magnet means positioned between said fluid supply means and said perforated screen.

11. Apparatus for controlling the thickness and distribution of coating on a sheet of material being drawn upwardly from a bath of liquid coating material comprising:

(a) upper and lower lip members extending transversely of said sheet, each of said upper and lower lip members having a fixed contour and cooperating to define an elongated outlet orifice, said orifice having opposing ends and a central portion therebetween, and having minimum gap opening at said central portion and tapering to maximum gap opening at each of said ends;

(b) fluid supply means for supplying fluid under pressure;

(c) support means for supporting said upper and lower lip members and defining a chamber for receiving pressurized fluid from said fluid supply means and directing said pressurized fluid toward said outlet orifice;

(d) an elongated diffuser bar positioned in said chamber spaced from and substantially parallel to said outlet orifice;

(e) a plurality of spaced apart stiffener bars supported on said support means within said chamber on the opposite side of said diffuser bar from said outlet orifice.

12. Apparatus according to claim 11 further including means for adjustably fastening said diffuser bar to said stiffener bars in any of a plurality of positions at varying distances from said outlet orifice.

13. Apparatus according to claim 11 further including magnet means for removing particles from said pressurized fluid prior to their reaching said outlet orifice.

14. Apparatus according to claim 11 further including magnet means positioned between said fluid supply means and said elongated diffuser bar.

15. Apparatus according to claim 14 further including a perforated screen positioned between said fluid supply means and said elongated diffuser bar.

16. Apparatus according to claim 15 wherein said perforated screen has holes over substantially the entire surface, said holes having a size in the range of 0.1 to 0.2 square inch, and being substantially uniformly spaced apart from one another.

17. Apparatus for controlling the thickness and distribution of coating on a sheet of material being drawn upwardly from a bath of liquid coating material comprising:

(a) a tubular manifold extending transversely of said sheet from a first end to a second end, said tubular manifold having an elongated slot with a length at least equal to the width of said sheet;

(b) fluid supply means for supplying fluid under pressure to each of said first and second ends;

(c) support means encircling said elongated slot mounted on and extending outwardly from said tubular manifold;

(d) upper and lower lip members mounted on said support means, each of said upper and lower lip members having a fixed contour and cooperating to define an elongated outlet orifice, said orifice having opposing ends and a central portion therebetween, and having minimum gap opening at said central portion and tapering to maximum gap opening at each of said ends, said upper and lower lip members cooperating with said support means to define a chamber for receiving pressurized fluid from said fluid supply means and directing said pressurized fluid toward said outlet orifice;

(e) an elongated diffuser bar positioned in said chamber spaced from and substantially parallel to said outlet orifice; and (f) means for supporting said diffuser bar from deflection.

18. Apparatus according to claim 17, wherein said means for supporting said diffuser bar from deflection comprises a plurality of spaced apart stiffener bars supported on said support means within said chamber.

19. Apparatus according to claim 18, wherein said stiffener bars are positioned on the opposite side of said diffuser bar from said outlet orifice.

20. Apparatus according to claim 18 further including means for adjustably fastening said diffuser bar to said stiffener bars in any of a plurality of positions at varying distances from said outlet orifice.

21. Apparatus according to claim 17 further including means for adjustably supporting said diffuser bar in positions relatively closer to or further from said outlet orifice.

22. Apparatus according to claim 17 further including magnet means for removing particles from said pressurized fluid prior to its reaching said outlet orifice.

23. Apparatus according to claim 17 further including magnet means positioned within said tubular manifold.

24. Apparatus according to claim 17 further including a perforated screen positioned in said tubular manifold over said elongated slot.

25. Apparatus according to claim 17 wherein said perforated screen has holes over substantially the entire surface, said holes having a size in the range of 0.1 to 0.2 square inch, and being substantially uniformly spaced apart from one another.

26. Apparatus according to claim 17 wherein said support means comprises a nozzle holder having spaced apart upper and lower walls on opposite sides of said elongated slot and end walls extending between said upper and lower wall at opposite ends of said slot and said upper lip member is supported on said upper wall and said lip member is supported on said lower wall.

* * * * *